US005762444A

United States Patent [19]

Giannelli

[11] Patent Number: 5,762,444

[45] Date of Patent: Jun. 9, 1998

[54] A-FRAME BARRICADE

[75] Inventor: Jeffrey M. Giannelli, Mt. Prospect, Ill.

[73] Assignee: Cortina Tool & Molding Co.

[21] Appl. No.: 702,235

[22] Filed: Aug. 27, 1996

[51] Int. Cl.[6] ..... B25H 1/06; E01F 13/02

[52] U.S. Cl. ..... 404/9; 116/63 P; 256/64; 182/183.1

[58] Field of Search ..... 256/1, 13.1, 64, 256/67, 19, DIG. 6; 404/6, 9; 116/63 P; 182/181.1, 183.1

[56] References Cited

U.S. PATENT DOCUMENTS

| | | | |
|---|---|---|---|
| 3,089,682 | 5/1963 | Parker | 256/64 |
| 3,380,429 | 4/1968 | Moinicken et al. | 166/63 P X |
| 4,804,064 | 2/1989 | Coultrup et al. | 182/183.1 X |
| 4,943,035 | 7/1990 | Thomson et al. | 256/1 X |
| 4,968,177 | 11/1990 | Bechtold | 116/63 P X |
| 5,467,548 | 11/1995 | Ross | 404/9 X |

*Primary Examiner*—James Lisehora

*Attorney, Agent, or Firm*—Jones, Day, Reavis & Pogue

[57] ABSTRACT

An A-frame barricade has the capability of being adjusted to a desired length. The barricade includes a pair of A-frame leg support members and a generally elongate beam assembly which connects the leg support members. The beam assembly is comprises two beam members which are slidably joined by interlocking elements to enable adjustment of the length of the barricade.

5 Claims, 4 Drawing Sheets

A-FRAME BARRICADE

BACKGROUND OF THE INVENTION

1. Field of the Invention

The present invention relates generally to a barricade of a type suitable for use at construction or other work sites or for crowd control and, more particularly, to a novel A-frame barricade which has the capability of being adjusted to a desired length.

2. Description of the Prior Art

At construction or work sites where vehicular or pedestrian traffic must be warned of possible danger it is a common practice to mark or surround the site with barricades. Such barricades are also often used for crowd control. Many forms of barricades exist depending on the nature of the hazard to be protected against. One popular barricade is an A-frame type having a pair of A-frame support assemblies which serve as opposed legs connected by a transverse beam. Such a barricade can be simply assembled from dimension lumber such as 2×4's, 2×6's, and the like and is often brightly painted or provided with light reflective tape. Suitable battery-powered flashing lights may also be mounted on these barricades for night-time warning use. These barricades are particularly suitable for use during street or sidewalk repair and are capable of being set up with minimal manual labor.

In recent times, A-frame barricades have become available which are molded from a suitable plastic material and designed such that the A-frame supports can be readily assembled to or disassembled from the connecting cross beam. Such construction provides for a barricade which has an advantage over wood construction in that the barricade is not only light weight, but it can also be conveniently transported or stored in a disassembled state.

A significant disadvantage of prior A-frame barricades, whether of the wooden or plastic variety is that they have been constructed in fixed lengths. Moreover, when it is desired to barricade off a small construction or work area where it is not necessary or convenient to use a large barricade, a specially sized smaller barricade might be preferable. This variance in required sizes of barricades can cause inconvenience to the construction contractor inasmuch as an inventory of different size barricades is then required.

SUMMARY OF THE INVENTION

The present invention improves over the prior art by providing an A-frame barricade comprising a pair of A-frame leg support members and a generally elongate beam assembly connecting the leg supports. The beam assembly comprises two elongate members having interlocking portions permitting the members to be joined for slidable longitudinal movement relative to one another whereby the barricade may be adjusted to a desired length.

Thus, it is a primary object of the present invention to provide barricades which can be manually adjusted lengthwise to suit a wide range of construction, work site or other applications.

BRIEF DESCRIPTION OF THE DRAWINGS

The foregoing and other novel features of the invention will be better understood upon a reading of the following detailed description taken in conjunction with the accompanying drawings wherein.

DETAILED DESCRIPTION OF THE PREFERRED EMBODIMENTS

Figure 1:
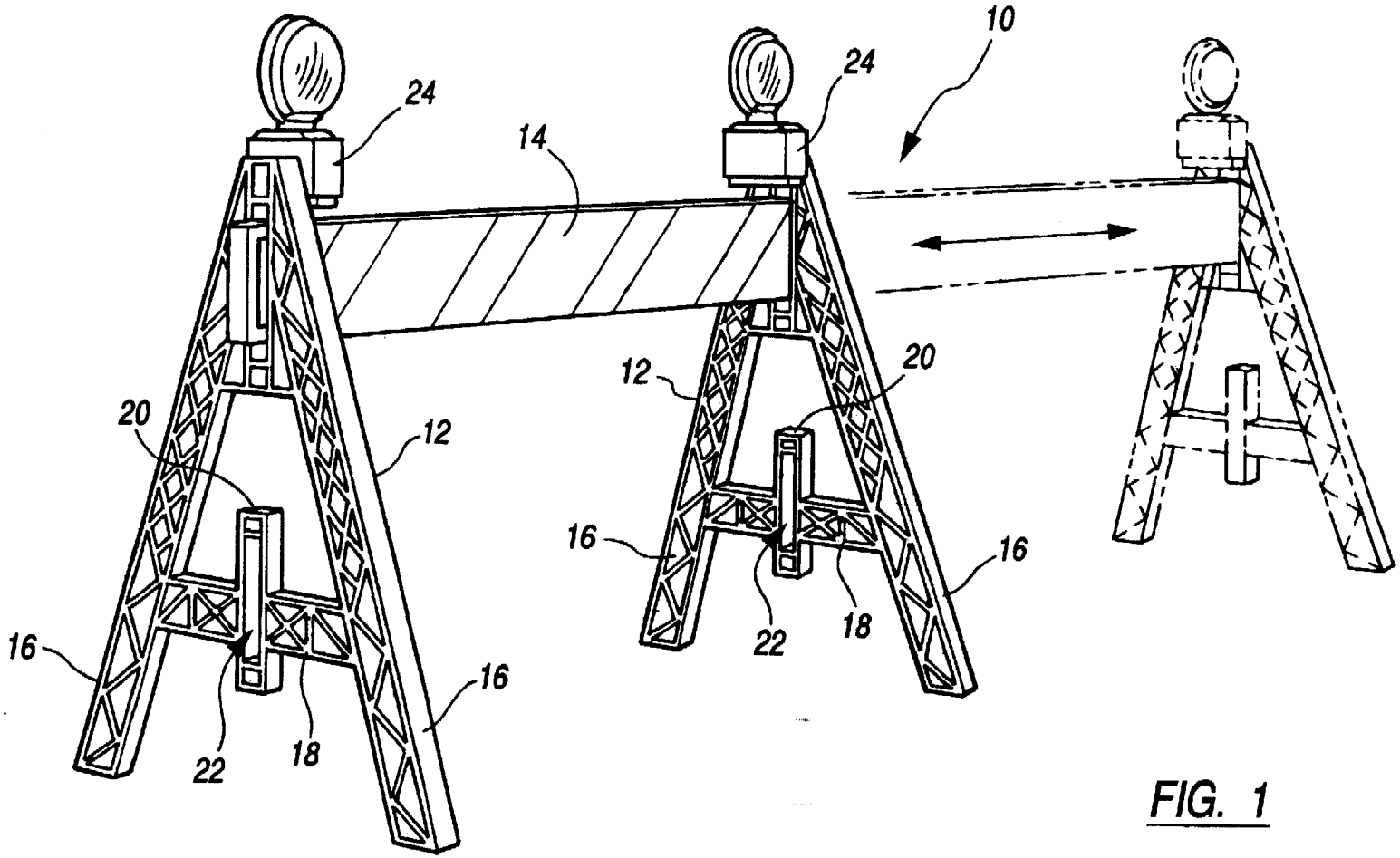
FIG. 1 is a front perspective view, partially in phantom, illustrating a barricade constructed in accordance with the principles of the invention.

Referring now to the drawings, and initially to FIG. 1, a barricade suitable for use at work sites and constructed in accordance with the principles of the invention is designated generally by the reference numeral 10. The barricade 10 includes as its principal components a pair of A-frame support members 12 connected by a generally elongate transverse beam assembly 14. The A-frame support members 12, preferably, are molded as unitary members from a suitable plastic material and comprise leg portions 16 connected by a cross brace portion 18.

Figure 2:
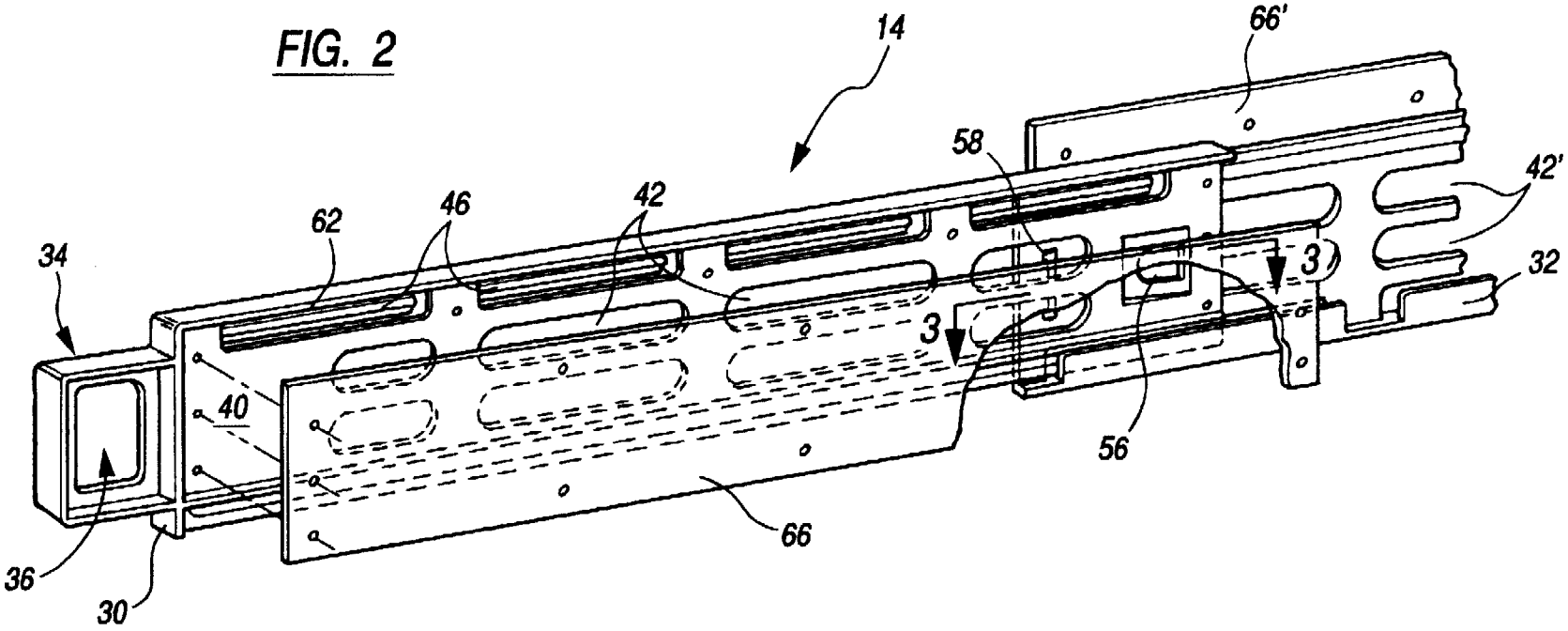
FIG. 2 is a fractional, exploded perspective view of cross beam assembly for the barricade.

In a preferred form, the support members 12 are molded with integral brackets 20 providing apertures 22 which may be used to receive an auxiliary cross beam (not shown) extending between the brace portions 18. The auxiliary cross beam can be used to support one or more sand bags to add weight to the barricade 10 and prevent it from easily being knocked over such as in windy conditions. The barricade may also be fitted with suitable battery-powered hazard lights 24 for use in night-time conditions. In accordance with the invention and as illustrated in phantom in FIG. 1, the barricade is designed to be extendable as will be described hereinafter in detail. Turning now to FIG. 2, a cross beam assembly 14 in accordance with the invention is illustrated in an extended condition and can be seen to include two main beam members 30 and 32 which are interlocking and slidable longitudinally of each other. The ends of the beam members 30 and 32 are formed with extensions 34 which are dimensioned and configured to slide through corresponding apertures provided in upper portions of A-frame supports 12 as well as in the apertures 22 provided in the brackets 20 of the cross brace portions 18 of the supports 12. Suitable openings 36 may be provided in the extensions 34 such that the extensions 34 also serve as handles.

Figure 4:
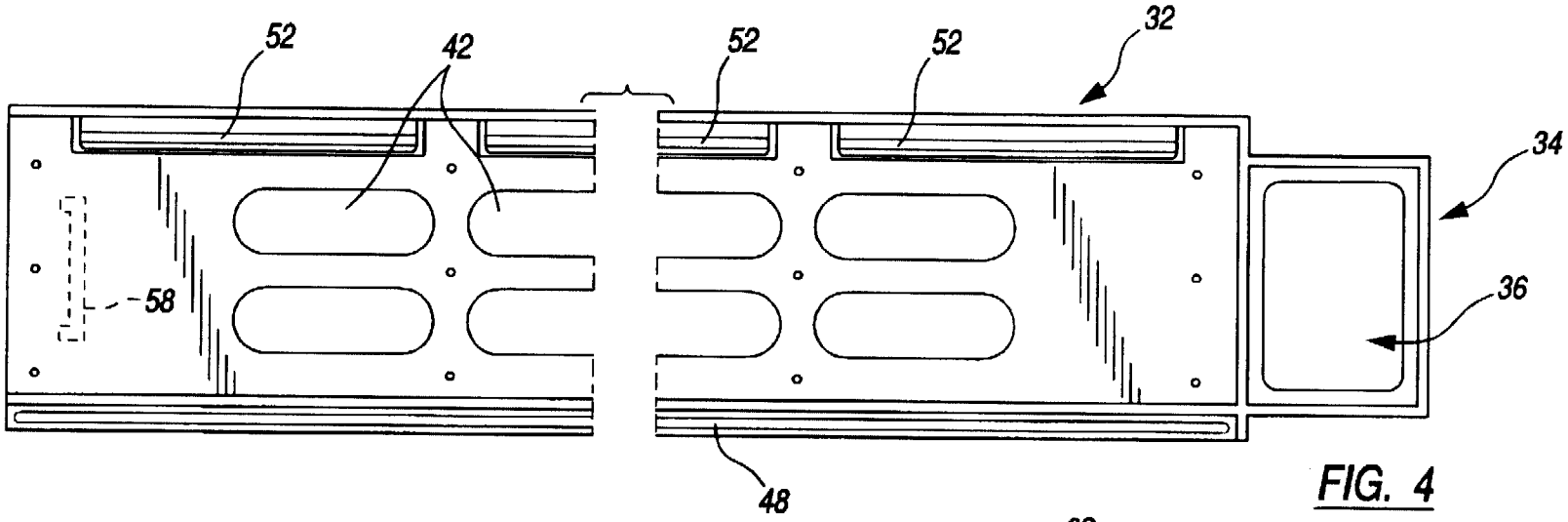
FIG. 4 is a plan view illustrating one side of a component of the cross beam assembly.
Figure 5:
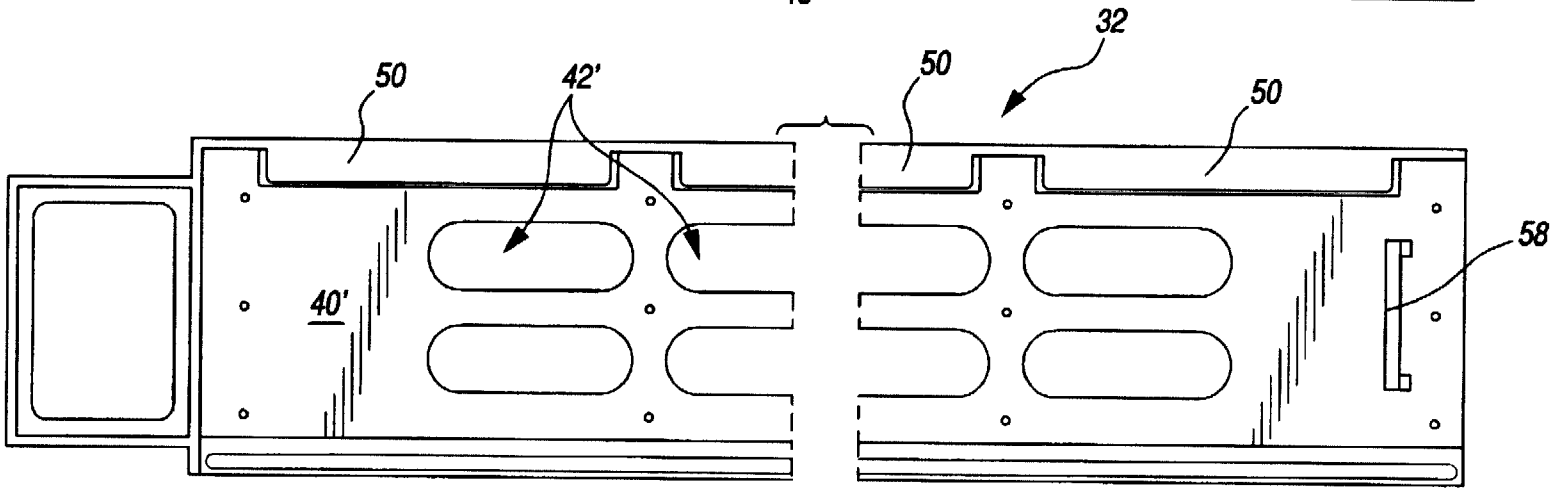
FIG. 5 is a plan view illustrating a second side of the component of FIG. 4.
Figure 6:
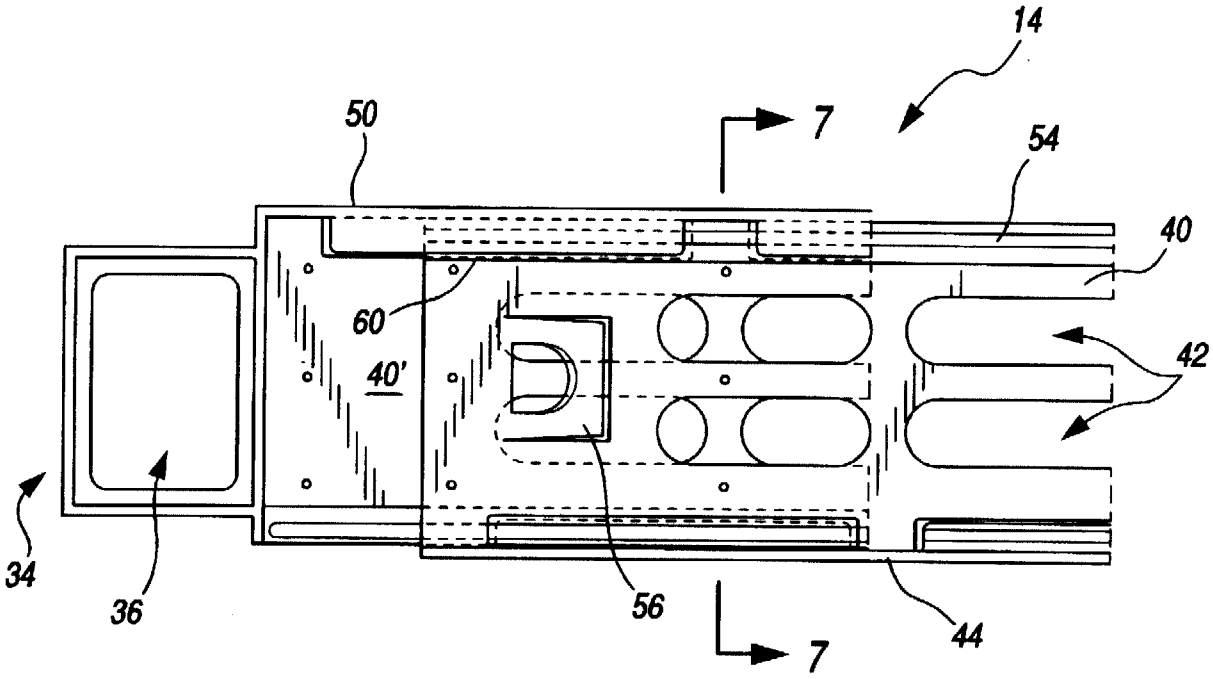
FIG. 6 is a partial plan view of the cross beam assembly.

Referring to FIGS. 4–6, the beam members 30 and 32 can be seen to have generally planar central panel portions 40 and 40' which are preferably formed with a plurality of spaced openings 42 and 42'. The openings 42 and 42' serve to conserve material in the construction of the beam members 30 and 32.

Figure 7:
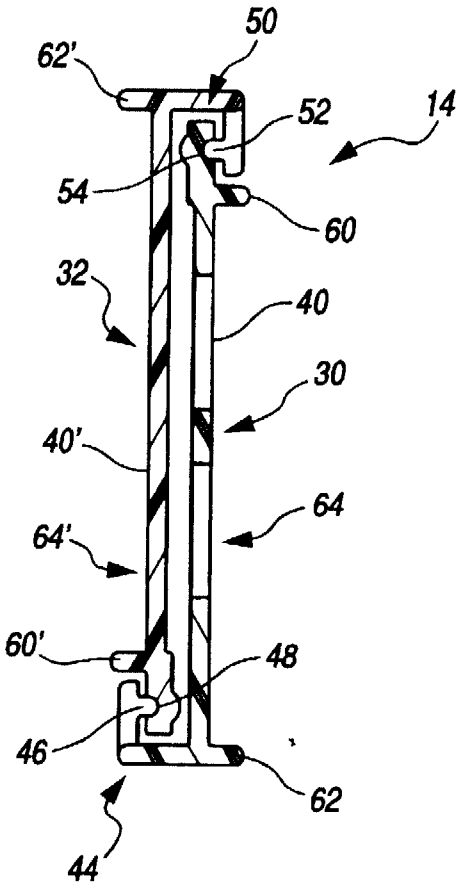
FIG. 7 is a cross-sectional view of the beam assembly taken substantially along the line 7—7 of FIG. 6.

The interlocking nature of the beam members 30 and 32 can best be seen in the cross-sectional view of FIG. 7. Formed integrally with the panel portion 40 of beam member 30 along the lower edge thereof is a generally J-shaped portion 44 as viewed in cross-section in FIG. 7 and a longitudinally extending tongue 46 projects from the terminal end of the J-shaped portion 44. A longitudinally extending recess or groove 48 is positioned adjacent the lower edge of beam member 32 for engagement with the tongue 46 and the recess or groove 48 is dimensioned and configured to nestingly receive the tongue 46.

Similarly, at the upper edge of the beam assembly 14, as viewed in FIG. 7, a generally J-shaped portion 50 in cross-section is integrally formed with the panel portion 40' of the beam member 32. A longitudinally extending tongue 52 projects from the terminal end of this J-shaped portion 50. Likewise, a longitudinally extending recess or groove 54 is positioned adjacent the upper edge of beam member 32 for engagement with the tongue 52 and the recess or groove 54 is dimensioned and configured to nestingly receive the tongue 52.

Thus, the tongue 46 and groove 48, and the tongue 52 and groove 54, serve to interlockingly join the two beam members 30 and 32 while allowing them to slide longitudinally of each other. As seen in FIGS. 4 and 5, the J-shaped beam portions 44 and 50 need only be in sections and of partial length relative to the length of the beam members 30 and 32. This construction also serves to conserve material in the beam 14 construction.

A feature of the present invention is the provision of a latch mechanism comprising latch plate 56 and stop projection 58 which limits the beam members 30 and 32 from being extended too far and becoming disconnected.

Figure 3:
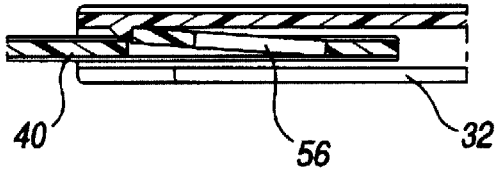
FIG. 3 is a partial cross-sectional view of the cross beam assembly taken substantially along the line 3—3 of FIG. 2.

As best illustrated in FIGS. 2 and 3, the latch plate 56 is angled inwardly of the beam assembly 14 from the central panel portion 40 of beam member 30. Correspondingly, the stop projection 58 is formed on the inside panel portion 40' of the beam member 32 and is engaged by the latch plate 56 when the beam members 30 and 32 are extended to an extreme relative position. Thus, the beam members 30 and 32 normally cannot separate when extended to the full length of the beam assembly 14. However, if it should be desired to separate or disconnect the two beam members 30 and 32, the latch plate 56, which is resiliently connected to the panel portion 40, can simply be manually grasped and bent to pass over the stop projection 58 releasing the locking engagement of the latch plate 56 and stop projection 58.

The barricade 10 of the present invention may be provided with a variety of means to increase its visibility during both daytime and night time conditions. For example, the panel portions 40 and 40' of the beam assembly 14 may be covered with a light reflective tape in a bright color such as red or orange. It is also common on barricades to use a light reflective sheeting having alternate bars of orange and white extending at an angle to horizontal.

In the construction of the present beam members 30 and 32, longitudinal ribs 60 and 60' may be provided, as best seen in FIG. 7. Also, rib extensions 62 and 62' of the J-shaped portions 44 and 50 may be provided cooperating with the ribs 60 and 60' to define panel recesses 64 and 64'. These recesses 64 and 64' may be suitably dimensioned to receive panel inserts 66 and 66' (FIG. 2) which may be secured to the panel portions 40 and 40' by suitable fasteners. The panel inserts 66 and 66' may be covered with the aforementioned reflective material or with sign letters or other indicia warning a passerby of possible danger.

It can now be appreciated that a barricade 10 constructed according to the invention provides a highly convenient means for warning of possible danger at construction or other work sites or for convenient use for crowd control. The barricade beam assembly 14 is preferably molded from a suitable plastic material as to be both durable and lightweight. Thus, the barricade 10 can readily be assembled and disassembled and is easily transported. In one preferred form, the beam assembly 14 is designed to extend within a range of between five to eight feet in length. The barricade 10 can thereby be used under a variety of work site conditions eliminating the need for having differing length barricades in inventory.

While the present invention has been described in connection with preferred embodiments thereof, it will be apparent to those skilled in the art that many changes and modifications may be made without departing from the true invention. Accordingly, it is intended by the appended claims to cover all such changes and modifications as come within the spirit and scope of the invention.

What is claimed is:

1. An A-frame barricade comprising:

a pair of A-frame leg support members; and a generally elongate beam assembly connecting said leg support members;

said beam asembly comprising a first and a second generally elongate beam member, said first and second beam members having interlocking portions joining said members for slidable longitudinal movement relative to one another enabling said barricade to be adjusted in length, said interlocking portion on said first beam member being generally J-shaped in cross-section formed adjacent a first edge of said first beam member and including a longitudinally extending tongue projecting from a terminal end thereof, said interlocking portion on said second beam member comprising a groove formed adjacent a first edge of said beam member and positioned to engage with said J-shaped portion of said first beam member.

2. The A-frame barricade of claim 1 wherein said groove on said second beam member nestingly receives said longitudinally extending tongue on said first beam member.

3. The A-frame barricade of claim 1 wherein said beam members are each formed with sidewalls having inset portions for receiving panels.

4. The A-frame barricade of claim 1 wherein one of said beam members is provided with a latch plate and said latch plate cooperates with a stop member provided on the other of said beam members to limit relative sliding movement of said beam members.

5. The A-frame barricade of claim 4 wherein said latch plate is resiliently connected to said one of said beam members to enable said beams to be disconnected.

* * * * *